US006543173B1

(12) United States Patent
Golan

(10) Patent No.: US 6,543,173 B1
(45) Date of Patent: Apr. 8, 2003

(54) FIREARM ASSEMBLY

(75) Inventor: Amos Golan, Kfar Azar (IL)

(73) Assignee: Corner Shot Holdings L.L.C., Coral Gables, FL (US)

( * ) Notice: Subject to any disclaimer, the term of this patent is extended or adjusted under 35 U.S.C. 154(b) by 0 days.

(21) Appl. No.: 09/961,353

(22) Filed: Sep. 25, 2001

(51) Int. Cl.[7] ..... F41A 21/00

(52) U.S. Cl. ..... 42/75.04; 42/77; 42/76.01; 42/90; 42/93; 89/14.05; 89/14; 89/15; 89/16

(58) Field of Search ..... 42/75.04, 77, 76.01, 42/90, 93; 89/14.05, 15.05, 16.05

(56) References Cited

U.S. PATENT DOCUMENTS

| | | | | | |
|---|---|---|---|---|---|
| 2,955,586 | A | * | 10/1960 | Hamrick | 124/27 |
| 3,262,440 | A | * | 7/1966 | Kuhn | 124/53 |
| 3,685,828 | A | * | 8/1972 | Getgey et al. | 124/62 |
| 3,729,848 | A | * | 5/1973 | Wilhelm et al. | 102/457 |
| 4,559,737 | A | * | 12/1985 | Washington | 102/504 |
| H202 | H | * | 2/1987 | Geeter | 89/14.05 |
| 4,798,461 | A | * | 1/1989 | Pavlin et al. | 356/138 |
| 4,912,869 | A | * | 4/1990 | Govett | 42/105 |
| 5,056,097 | A | * | 10/1991 | Meyers | 250/492.1 |
| 5,396,830 | A | * | 3/1995 | Kornblith et al. | 102/504 |
| 5,540,284 | A | * | 7/1996 | Esposito et al. | 169/62 |
| 6,119,671 | A | * | 9/2000 | Smith et al. | 124/59 |
| 6,276,085 | B1 | * | 8/2001 | Wooten et al. | 102/483 |
| 6,301,816 | B1 | * | 10/2001 | Saltz | 42/70.01 |
| 6,324,779 | B1 | * | 12/2001 | Tippmann, Jr. | 124/81 |
| 6,363,223 | B1 | * | 3/2002 | Gordon | 348/61 |
| 6,369,849 | B1 | * | 4/2002 | Rzyski | 348/158 |
| 6,381,894 | B1 | * | 5/2002 | Murphy | 42/77 |
| 6,385,894 | B1 | * | 5/2002 | Podvin | 42/117 |

FOREIGN PATENT DOCUMENTS

| | | | |
|---|---|---|---|
| CH | 143431 | X Y | 1/1931 |
| DE | 73415 | Y | 1/1894 |
| FR | 1027684 | Y | 5/1953 |

OTHER PUBLICATIONS

Army Ordnance—Attachment to M3 0.45 caliber gun showing 90 degree projectile deflection permitting firing around corners.*

* cited by examiner

*Primary Examiner*—Charles T. Jordan
*Assistant Examiner*—John Richardson
(74) *Attorney, Agent, or Firm*—David Klein; Dekel Patent Ltd.

(57) ABSTRACT

A firearm assembly including a fluid deflector adapted to be connected to a discharge end of a barrel of a firearm, the fluid deflector including a first passage for flow therethrough of a fluid and a second passage in fluid communication with and angled with respect to the first passage for flow therethrough of the fluid.

18 Claims, 4 Drawing Sheets

FIREARM ASSEMBLY

FIELD OF THE INVENTION

The present invention relates to firearms in general and, in particular, to firearms for shooting around corners.

BACKGROUND OF THE INVENTION

In order to fire a firearm and hit a target, it is necessary to aim towards the target and fire a bullet projectile with sufficient force to reach and damage the target. With conventional firearms, such as pistols, revolvers and other handguns, rifles, submachine guns and the like, an elongate barrel is provided to direct the bullet in the direction in which the firearm is aimed, and to provide a path along which the bullet is accelerated.

In many cases, it would be desirable to hit a target lying at an angle to, or around a corner from, the person firing the gun. With conventional firearms, this is impossible, since the barrel is straight and can only be fired forwards or backwards, or else the gun must be held extended from the body and fired without visually aiming towards the target.

SUMMARY OF THE INVENTION

The present invention seeks to provide a firearm assembly that permits firing around a corner at a target. In one embodiment of the invention, the firearm assembly comprises a fluid (i.e., gas or liquid) deflector that may deflect gas from an explosive charge to an auxiliary barrel that is angled with respect to a barrel of a firearm. The deflected gas may propel a projectile from the auxiliary barrel to a target. In another embodiment of the invention, the firearm assembly comprises a support stock with a stock trigger. A pivotal connector may pivotally connect a firearm to the support stock at any desired angle. A trigger connector may couple the stock trigger to the trigger of the firearm for remote firing of the firearm.

There is thus provided in accordance with an embodiment of the present invention a firearm assembly including a fluid deflector adapted to be connected to a discharge end of a barrel of a firearm, the fluid deflector including a first passage for flow therethrough of a fluid and a second passage in fluid communication with and angled with respect to the first passage for flow therethrough of the fluid. The fluid deflector may be attached to a discharge end of a firearm that has a barrel. Preferably, an auxiliary barrel portion is in fluid communication with the second passage, and a projectile may be disposed in the auxiliary barrel portion.

In accordance with an embodiment of the present invention the firearms includes a source of pressurized fluid, wherein the fluid flows through the first passage to the second passage to the auxiliary barrel portion. The fluid preferably has sufficient force to expel the projectile from the auxiliary barrel portion.

Further in accordance with an embodiment of the present invention a barrel adapter may be provided that is adapted to couple the fluid deflector with a discharge end of a barrel of a firearm.

In accordance with an embodiment of the present invention the second passage is pivotable relative to the first passage.

Further in accordance with an embodiment of the present invention aiming apparatus is provided that is adapted to aim the auxiliary barrel portion at a target.

Still further in accordance with an embodiment of the present invention the aiming apparatus includes a camera mounted on the auxiliary barrel portion, such that the camera moves together with the auxiliary barrel portion, and a monitor in communication with the camera, mounted on a portion of the firearm assembly.

In accordance with an embodiment of the present invention the source of pressurized fluid includes a blank cartridge.

Further in accordance with an embodiment of the present invention a locking device is provided that is adapted to secure the second passage at a fixed angle relative to the first passage.

Still further in accordance with an embodiment of the present invention the fluid deflector includes an inner cup, formed with an inner cavity in fluid communication with the first passage, the inner cup being rotatably mounted in an outer cup, wherein the second passage extends from the outer cup.

There is also provided in accordance with an embodiment of the present invention a firearm assembly including a support stock including a stock trigger, a pivotal connector mounted on the support stock and couplable to a firearm including a firearm trigger and a barrel, and a trigger connector adapted to couple the stock trigger to a firearm trigger for remote firing of a firearm.

In accordance with an embodiment of the present invention the pivotal connector includes a locking device adapted to releasably lock a firearm at an angle relative to the support stock.

Further in accordance with an embodiment of the present invention viewing apparatus is provided that may be mounted on the firearm, and a display is mounted on the support stock in communication with the viewing apparatus.

Still further in accordance with an embodiment of the present invention the viewing apparatus includes at least one of a camera and a mirror assembly substantially alignable with a barrel of the firearm.

Additionally in accordance with an embodiment of the present invention the viewing apparatus includes an interface connectable to an external display.

In accordance with an embodiment of the present invention aiming apparatus is provided that is alignable with the barrel of the firearm.

Further in accordance with an embodiment of the present invention the trigger connector includes at least one of a mechanical, electrical/electronic, pneumatic and hydraulic connector.

Still further in accordance with an embodiment of the present invention a safety catch is provided that is adapted to prevent inadvertent pulling of the stock trigger.

Additionally in accordance with an embodiment of the present invention an override unit is provided that is adapted to disable the aiming apparatus.

BRIEF DESCRIPTION OF THE DRAWINGS

The present invention will be further understood and appreciated from the following detailed description taken in conjunction with the drawing in which.

DETAILED DESCRIPTION OF THE INVENTION

Figure 1:
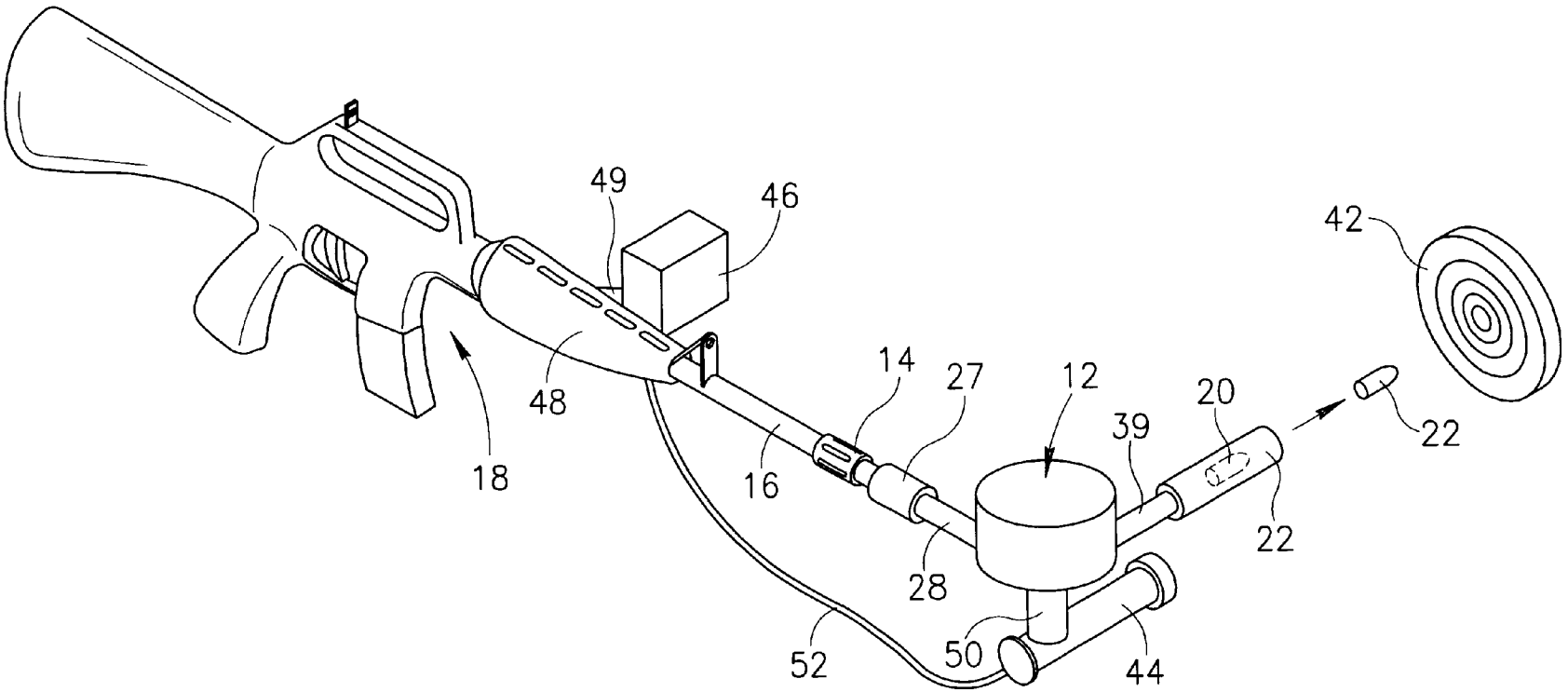
FIG. 1 is a simplified illustration of a firearm assembly constructed and operative in accordance with an embodiment of the invention.

Reference is now made to FIG. 1, which illustrates a firearm assembly 10 constructed and operative in accordance with an embodiment of the invention.

Firearm assembly 10 may include a fluid deflector 12 adapted to be connected to a discharge end 14 (e.g., a fire suppressor, also referred to in the art as a fire hider or arrester) of a barrel 16 of a firearm 18. For ease of illustration, firearm 18 is illustrated as a rifle. However, it is appreciated that the invention is applicable for any other kind of firearm. Fluid deflector 12 is adapted to receive fluid from a source of pressurized fluid, such as gas expelled from an explosive charge in firearm 18 through barrel 16, and deflect the fluid at an angle with respect to barrel 16 to an auxiliary barrel portion 20 connected to and in fluid communication with fluid deflector 12, as is explained more in detail hereinbelow. The auxiliary barrel portion 20 may have a projectile 22 disposed therein, and the fluid flowing through fluid deflector 12 may have sufficient force to expel projectile 22 from auxiliary barrel portion 20.

Figure 2A:
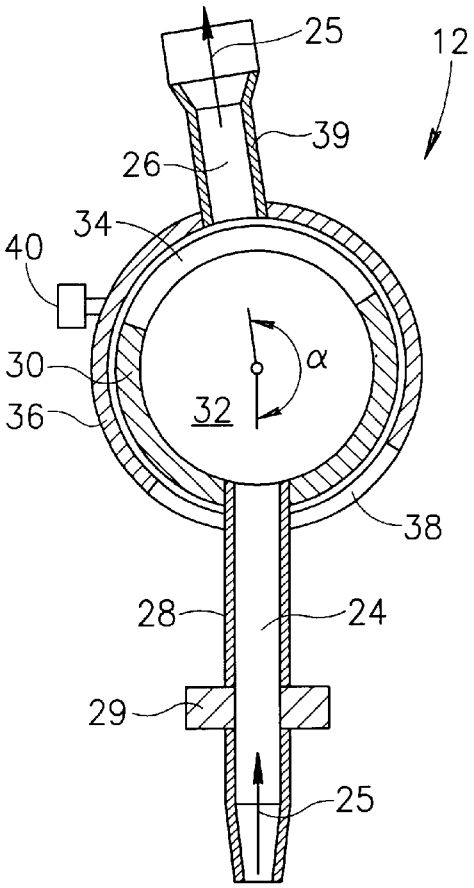
FIGS. 2A and 2B are simplified sectional illustrations of a fluid deflector of the firearm assembly of FIG. 1, constructed and operative in accordance with one embodiment of the invention.
Figure 2B:
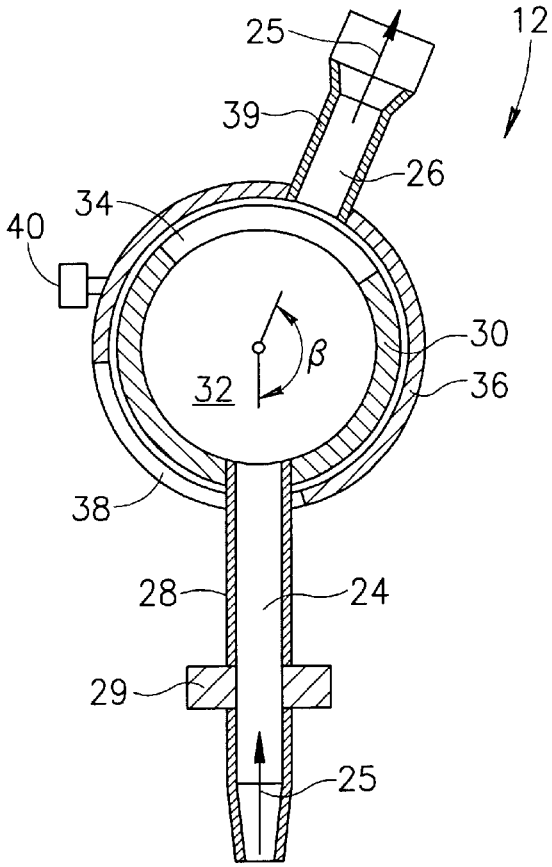

Reference is now made to FIGS. 2A and 2B, which are sectional illustrations of fluid deflector 12 constructed and operative in accordance with one embodiment of the invention. Fluid deflector 12 may comprise a first passage 24 for flow therethrough of a fluid 25 and a second passage 26 in fluid communication with and angled with respect to first passage 24 for flow therethrough of the fluid 25. Again, fluid 25 may emanate from a source of pressurized fluid, such as gas expelled from an explosive charge in firearm 18 through barrel 16.

First passage 24 may be formed in a barrel discharge coupling member 28. Barrel discharge coupling member 28 may be shaped to fit in and connect to discharge end 14 of barrel 16 of firearm 18 by any suitable manner, such as but not limited to, a press fit or a threaded connection 29, or by means of a barrel adapter 27 (FIG. 1), for example. Barrel discharge coupling member 28 may extend from an inner cup 30, formed with an inner cavity 32 and a radial aperture 34. Inner cavity 32 may be in fluid communication with first passage 24. Inner cup 30 may be rotatably mounted in an outer cup 36. Outer cup 36 may be formed with a radial aperture 38 through which pass barrel discharge coupling member 28 and first passage 24. Second passage 26 may extend from outer cup 36, and second passage 26 may be arranged to be in fluid communication with inner cavity 32 of inner cup 30 via radial aperture 38. Second passage 26 may be formed in an auxiliary barrel portion coupling member 39.

FIG. 2A illustrates fluid deflector 12 in one orientation wherein fluid 25 passes through first passage 24 and flows out of second passage 26 at an angle $\alpha$. FIG. 2B illustrates fluid deflector 12 in another orientation wherein fluid 25 passes through first passage 24 and flows out of second passage 26 at a different angle $\beta$.

Second passage 26 may be at a fixed angle with respect to first passage 24. Alternatively, second passage 26 may be pivotable relative to first passage 24. Second passage 26 may be adapted to rotate 360° relative to first passage 24, for example. A locking device 40 may be provided to secure inner and outer cups 30 and 36 together, so as to secure second passage 26 at a fixed angle relative to first passage 24. Locking device 40 may comprise without limitation a thumbscrew that passes through outer cup 36 and abuts against inner cup 30, or detents formed between inner and outer cups 30 and 36, or a pawl and ratchet mechanism, for example.

Reference is again made to FIG. 1. The firearm assembly 10 may further comprise aiming apparatus adapted to aim auxiliary barrel portion 20 at a target 42. The aiming apparatus may comprise without limitation a camera 44 mounted on auxiliary barrel portion 20 and a monitor 46 in communication with camera 44. Camera 44 may move together with auxiliary barrel portion 20 so that camera 44 always has the target 42 in sight. For example, camera 44 may be mounted on a swivel post 50 pivotally attached to fluid deflector 12. Monitor 46 may be mounted on any portion of firearm assembly 10, such as but not limited to, a hand guard 48 by means of a fastener 49 or other suitable hardware. Camera 44 may be connected to monitor 46 in any suitable manner, such as but not limited to, an electrical cable 52. A power source (not shown) may be provided for powering camera 44 and monitor 46.

One possible operation of firearm assembly 10 in accordance with the present invention is now described.

Barrel discharge coupling member 28 is connected to discharge end 14 of barrel 16 of firearm 18. Second passage 26 is secured at a fixed angle relative to first passage 24 with locking device 40. One or more projectiles 22 are inserted into the open end of auxiliary barrel portion 20. According to one embodiment of the invention, the projectiles may be rubber bullets or paint balls in an arcade, as they are relatively light in weight. However, any other projectile may be fired if sufficient fluid pressure is generated within firearm 18 and fluid deflector 12 is built of sufficiently strong materials.

Firearm 18 comprises a source of pressurized fluid (liquid or gas) for expelling projectiles 22. According to an embodiment of the invention, firearm 18 is loaded with blank cartridges (cartridges with explosive powder but without a bullet). Upon firing firearm 18, a blast of pressurized gas travels down barrel 16. The blast of gas travels into barrel discharge coupling member 28 into first passage 24 of fluid deflector 12, and then through second passage 26 into auxiliary barrel portion 20, propelling projectile 22 from auxiliary barrel portion 20 towards the target 42.

Figure 3:
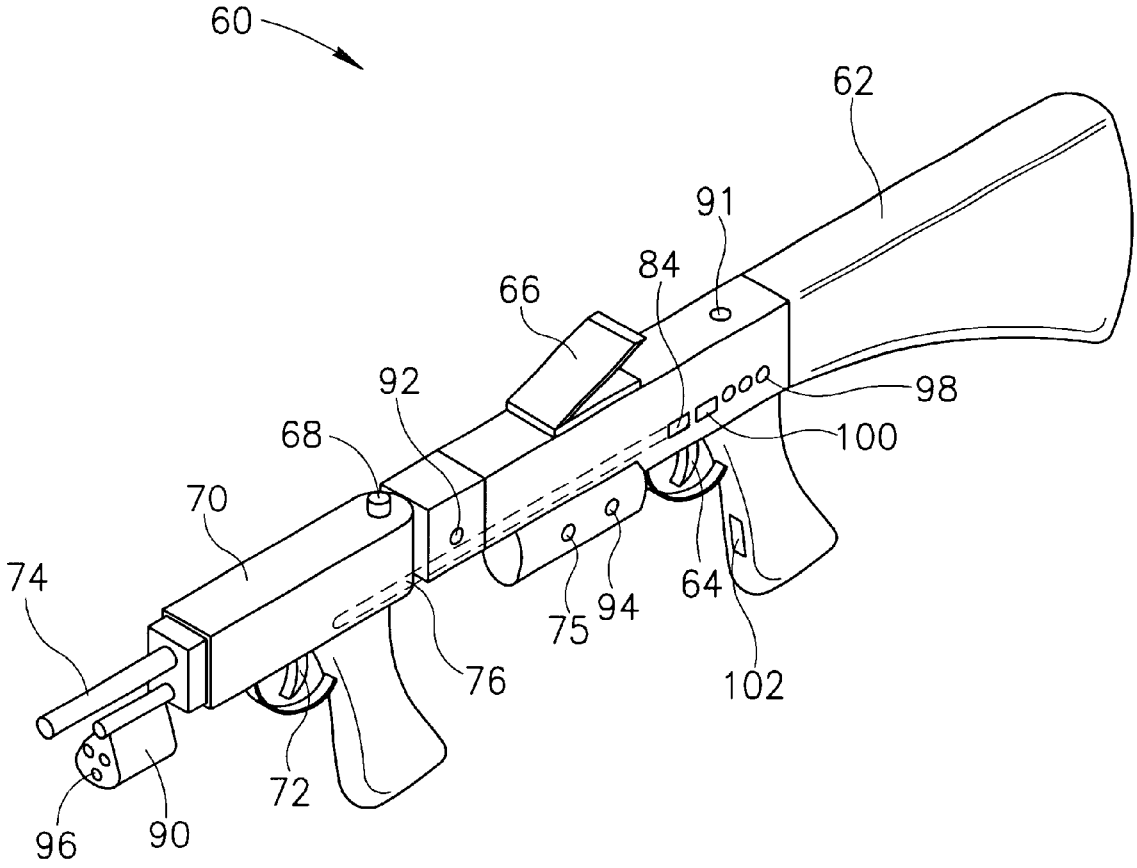
FIG. 3 is a simplified illustration of a firearm assembly constructed and operative in accordance with another embodiment of the invention.

Reference is now made to FIG. 3, which illustrates a firearm assembly 60 constructed and operative in accordance with another embodiment of the invention, and also suitable for firing projectiles around a corner at a target.

Firearm assembly 60 may comprise a support stock 62 having a stock trigger 64 and a display 66. A pivotal connector 68, such as a hinge and clamp, may be mounted on a distal end of support stock 62 and arranged for pivotal coupling to a firearm 70, such as, but not limited to, a handgun, revolver, pistol, submachine gun, or rifle. Firearm 70 may comprise a firearm trigger 72 and a barrel 74. Pivotal connector 68 may comprise a locking device 75 for releasably locking firearm 70 at an angle relative to support stock 62. Locking device 75 may comprise without limitation a thumbscrew, locking detents, pawl and ratchet mechanism, or electrical/electronic, hydraulic or pneumatic release device, for example.

Alternatively, the pivotal connector 68 of support stock 62 may be adapted so that firearm 70 may be rotated 360° relative to support stock 62. For example, a robotic arm may be employed to rotate firearm 70 at any angle and revolve any number of revolutions.

A trigger connector 76 may couple stock trigger 64 to the firearm trigger 72 for remote firing of the firearm. Thus, a person holding the support stock 62 on which firearm 70 is mounted may actuate the firing mechanism of firearm 70 from a remote location. Trigger connector 76 may comprise any kind of connector that permits remote firing of the firearm 70, such as but not limited to, a mechanical, electrical/electronic, pneumatic or hydraulic connector, for example.

For example, according to one embodiment of the invention, trigger connector 76 comprises a mechanical connector, such as but not limited to, a cable (not shown) that couples stock trigger 64 to firearm trigger 72. The cable may be arranged to slide within a sleeve (not shown), such as in a manner similar to bicycle hand brakes. Calibration apparatus 84, such as but not limited to, calibrating nuts may be provided for adjusting the length of trigger connector 76 (if a mechanical trigger is used), which changes depending upon the particular firearm mounted on the support stock 62. Pulling stock trigger 64 causes firearm trigger 72 to be pulled by trigger connector 76, thereby firing the firearm 70.

Firearm assembly 60 may further comprise viewing apparatus 90, which may be mounted on the firearm 70, such as but not limited to, beneath barrel 74. Viewing apparatus 90 may comprise without limitation a camera, mirror assembly or any other scanning or viewing device that permits viewing a target (not shown). Images viewed by viewing apparatus 90 may be displayed on display 66, which may be in electrical or any other kind of communication with Ewing apparatus 90. Alternatively, an interface 91 may be provided that is connectable to an external display, such as but not limited to, a helmet display or command post display (not shown).

Additional pinhole cameras 92 or other viewing devices may be provided on either side of support stock 62 to increase the field of view. When there is more than one viewing device, a selector button 94 may be provided to permit selection of the desired viewing device for displaying images on display 66 or an external display.

Firearm assembly 60 may also comprise aiming apparatus 96, which is preferably mounted together with viewing apparatus 90 substantially aligned with barrel 74. Aiming apparatus 96 may be any suitable aiming apparatus, such as but not limited to, laser, infrared, or focused light source, for example, or any combination of such apparatus. One or more selector buttons 98 may be provided on support stock 62 coupled to aiming apparatus 96 for selecting the desired aiming device, when more than one device is present.

Firearm assembly 60 may comprise various safety mechanisms. For example, a safety catch 100 may be provided to prevent inadvertent pulling of the stock trigger 64. An override unit 102 may be provided that disables aiming apparatus 96, for example.

Figure 4:
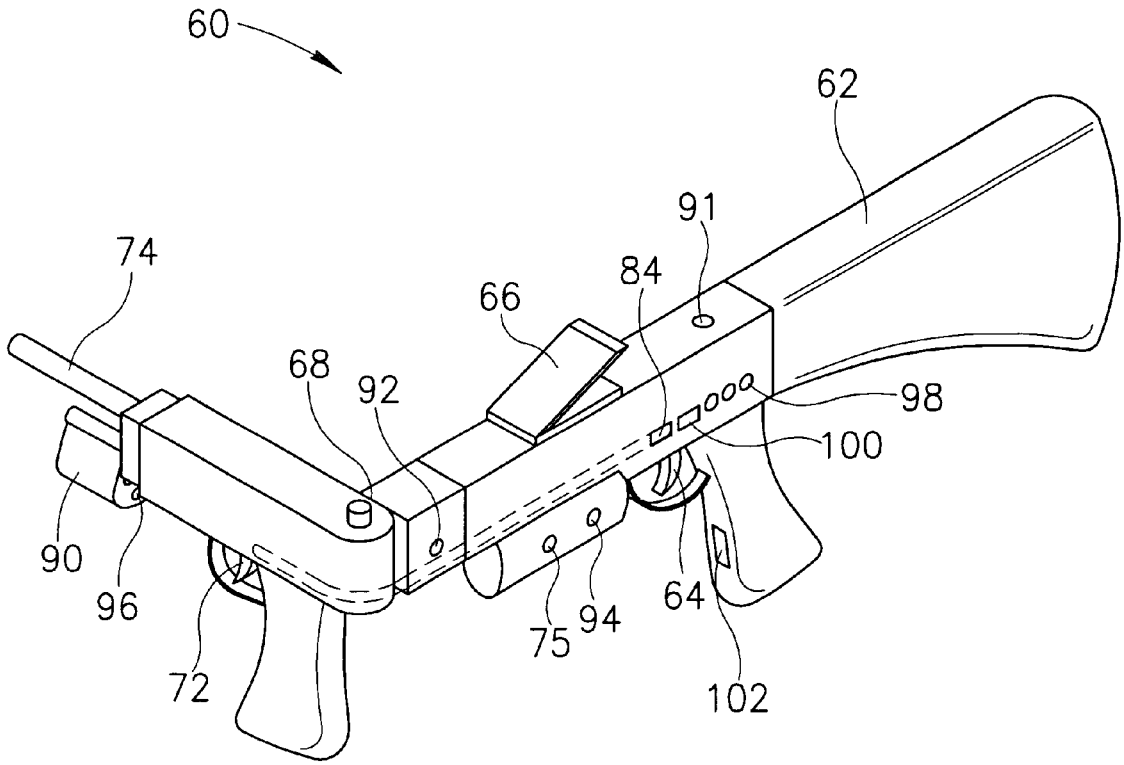
FIG. 4 is a simplified illustration of the firearm assembly of FIG. 3 in a pivoted orientation.

One possible operation of firearm assembly 60 in accordance with the present invention is now described with reference to FIGS. 3 and 4. When it is desired to use the firearm assembly 60 when breaking into a building or room in which an enemy may be waiting, for example, a user (not shown) may stand beside a door of the building or room with the firearm assembly 60 in the orientation of FIG. 3. Pivotal connector 68 may be released, such as by releasing locking device 75, and firearm 70 is pivoted to the desired angle for viewing and firing. For example, FIG. 4 illustrates firearm 70 positioned at an angle of about 35° with respect to support stock 62. This angle may permit firing around a corner without exposing the user to someone inside the room, and permits freedom of movement without the firearm 70 becoming caught in the door or wall.

The firearm 70, with attached viewing apparatus 90, may be inserted though the door, and the user may view the interior of the space or room on display 66. It is possible in this fashion to view first the area on one side of the door, and then pivot the firearm 70 and viewing apparatus 90 to the other side and view the area on the other side of the door. It is appreciated that it is possible to shoot the firearm 70 in any of these positions. The aiming selector button or buttons 98 may be pressed to select an aiming device of aiming apparatus 96 to improve the aim of the user who only sees the target on display 66.

Pivotal connector 68 may be spring-loaded. In such a case, once the user goes into the room or space, locking device 75 may be used to release pivotal connector 68, whereupon firearm 70 springs back to the orientation of FIG. 3, and firearm 70 may operate as an ordinary hand-held firearm.

It will be appreciated that the invention is not limited to what has been described hereinabove merely by way of example. Rather, the invention is limited solely by the claims that follow.

What is claimed is:

1. A firearm assembly comprising:

a support stock comprising a stock trigger;

a pivotal connector mounted on said support stock and couplable to a separate pivotally mounted firearm comprising a firearm trigger and a barrel, and a trigger connector adapted to couple said stock trigger to a firearm trigger for remote firing of a firearm.

2. The firearm assembly according to claim 1 wherein said pivotal connector comprises a locking device adapted to releasably lock a firearm at an angle relative to said support stock.

3. The firearm assembly according to claim 1 and further comprising viewing apparatus mountable on the firearm, and a display mounted on said support stock in communication with said viewing apparatus.

4. The firearm assembly according to claim 3 wherein said viewing apparatus comprises at least one of a camera and a mirror assembly substantially alignable with a barrel of the firearm.

5. The firearm assembly according to claim 3 wherein said viewing apparatus comprises an interface connectable to an external display.

6. The firearm assembly according to claim 1 and further comprising aiming apparatus alignable with the barrel of the firearm.

7. The firearm assembly according to claim 1 wherein said trigger connector comprises at least one of a mechanical, electrical/electronic, pneumatic and hydraulic connector.

8. The firearm assembly according to claim 1 and further comprising a safety catch adapted to prevent inadvertent pulling of said stock rigger.

9. The firearm assembly according to claim 6 and further comprising an override unit adapted to disable said aiming apparatus.

10. A firearm assembly comprising:

a support stock comprising a stock trigger;

a pivotal connector mounted on said support stock and coupled to a separate pivotally mounted firearm comprising a firearm trigger and a barrel, and a trigger connector adapted to couple said stock trigger to said firearm trigger for remote firing of said firearm.

11. The firearm assembly according to claim 10, wherein said pivotal connector comprises a locking device adapted to releasably lock said firearm at an angle relative to said support stock.

12. The firearm assembly according to claim 10, further comprising viewing apparatus mountable on said firearm, and a display mounted on said support stock in communication with said viewing apparatus.

13. The firearm assembly according to claim 12, wherein said viewing apparatus comprises at least one of a camera and a mirror assembly substantially alignable with said barrel of said firearm.

14. The firearm assembly according to claim 12, wherein said viewing apparatus comprises an interface connectable to an external display.

15. The firearm assembly according to claim 10, further comprising aiming apparatus alignable with said barrel of said firearm.

16. The firearm assembly according to claim 15, further comprising an override unit adapted to disable said aiming apparatus.

17. The firearm assembly according to claim 10, wherein said trigger connector comprises at least one of a mechanical, electrical/electronic, pneumatic and hydraulic connector.

18. The firearm assembly according to claim 10, further comprising a safety catch adapted to prevent inadvertent pulling of said stock trigger.

* * * * *